United States Patent [19]

Lukawich et al.

[11] Patent Number: 4,480,566

[45] Date of Patent: Nov. 6, 1984

[54] MENDING ATTACHMENT FOR A SEWING MACHINE

[75] Inventors: Joseph J. Lukawich, Somerville; Kenneth D. Adams, Madison, both of N.J.

[73] Assignee: The Singer Company, Stamford, Conn.

[21] Appl. No.: 525,929

[22] Filed: Aug. 25, 1983

[51] Int. Cl.[3] ..... D05B 27/20; D05B 3/02

[52] U.S. Cl. ..... 112/321; 112/236

[58] Field of Search ..... 112/158 R, 321, 236

[56] References Cited

U.S. PATENT DOCUMENTS

| | | | |
|---|---|---|---|
| 521,855 | 6/1894 | Gohring . | |
| 1,714,021 | 5/1929 | Gury, Jr. . | |
| 2,084,838 | 6/1937 | Dobyne . | |
| 2,491,685 | 12/1949 | Munz . | |
| 2,864,327 | 12/1958 | Cole et al. . | |
| 2,874,664 | 2/1959 | Waterman | 112/236 |
| 4,292,907 | 10/1981 | Gilbride et al. | 112/236 |
| 4,372,237 | 2/1983 | Totino et al. . | |

OTHER PUBLICATIONS

U.S. Pat. Ser. No. 526,228, Aug. 25, 1983, J. J. Lukawich.

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A presser attachment device for implementing needle feed in which a presser foot is elevated when a sewing needle is in engagement with work material to facilitate lateral shift thereof by the sewing needle. The presser foot is supported on one end of a substantially centrally pivoted presser foot carrier lever, the other end of which is formed with a gear segment. A pinion and ratchet combination is supported on one end of a pinion carrier lever, the other end of which is carried on the presser foot carrier lever pivot and has a pinion portion thereof in engagement with the gear segment. A combined cam and pawl is provided in which a pawl portion is in engagement with a ratchet portion of the combined pinion and ratchet when the sewing needle extends through the work material so as to lock the pinion against further rotation, depress the pinion and rotate the presser foot carrier lever to elevate the presser foot out of contact with the work material. When the sewing needle is not in engagement with the work material, the pinion is free to rotate to accommodate to the thickness of the work material beneath the presser foot.

4 Claims, 5 Drawing Figures

MENDING ATTACHMENT FOR A SEWING MACHINE

BACKGROUND OF THE INVENTION

This invention is in the field of sewing machine attachments; more particularly, it is concerned with an improved attachment which facilitates needle feed of work material in a sewing machine in which presser foot pressure is normally constant.

In a prior art device, a combination needle feed and even feed attachment is provided which, selectively, implements lateral feeding of a work material by a sewing needle, or longitudinal feeding thereof by means of a work feeding foot which cooperates with motion of the sewing machine feed dog to shift the upper and lower plies of a work material in a longitudinal direction. The combination attachment is supported on a presser bar of a sewing machine. Needle feed is implemented by shifting the presser foot upwardly when the sewing needle is in engagement with a work material so as to reduce the pressure on the work material and to enable ready lateral shifting thereof. The presser foot is carried on one end of a presser foot carrier lever which is pivoted substantially centrally thereof and is fashioned with a gear segment opposite the end supporting the presser foot. A pinion is maintained in mesh with the gear segment and is carried on a pin on the end of a pinion carrier lever pivoted beyond the pinion from the pivot axis of the presser foot carrier lever. A pinion lock is pivoted adjacent the pinion carrier lever and is formed on the opposite end thereof with a tooth or teeth designed for engagement with the pinion to check rotation thereof pursuant to additional pressure on the pinion lock to rotate the presser foot carrier lever and thereby elevate the presser foot out of contact with the work material. Pressure is applied to the pinion lock by a push lever, by means of a roller on a drive lever connected to the reciprocating needle bar to influence rotation thereof, and, thereby, rotation of the presser foot carrier lever, when the sewing needle enters into engagement with a work material.

Such an attachment device has been found to be efficacious for stitching patches to a garment because of its capability for longitudinal and lateral feeding. What is required is an improved needle feed attachment device which is substantially similar to the combined device but eliminates many parts and combines other parts thereof to provide a considerably simplier and more economical assembly.

SUMMARY OF THE INVENTION

The above requirements are achieved in an improved attachment in which, as before, a presser foot is retained on one end of a presser foot carrier lever the other end of which is formed into a gear segment. A pinion carrier lever is provided which is pivoted on the same axis as the presser foot carrier lever so that the mesh between the gear segment on the end of the presser foot carrier lever, and pinion teeth on a combined pinion and ratchet pivotably carried on a rod on the other end of the pinion carrier lever, is not disturbed by rotation of the presser foot and pinion carrier levers. The ratchet teeth of the combined pinion and ratchet, are engaged by a pawl on a combined pawl and cam when the sewing needle is in engagement with a work material to lock the position of the presser foot according to the thickness of the material therebeneath and to elevate the same a distance above the work material in order to allow unimpeded lateral shift of the work material by the sewing needle. The construction thus provided substantially simplifies the prior art device to reduce the cost thereof, while at the same time improving operation of the device by increasing the strength and improving wear thereof.

DESCRIPTION OF THE DRAWINGS

While the specification concludes with claims particularly pointing and distinctly claiming the subject matter which is regarded as forming the present invention, it is believed that the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

FIG. 2 is a section taken along line 22 of FIG. 1 to show the state of the presser bar with the attachment affixed thereto;

DETAILED DESCRIPTION

Figure 1:
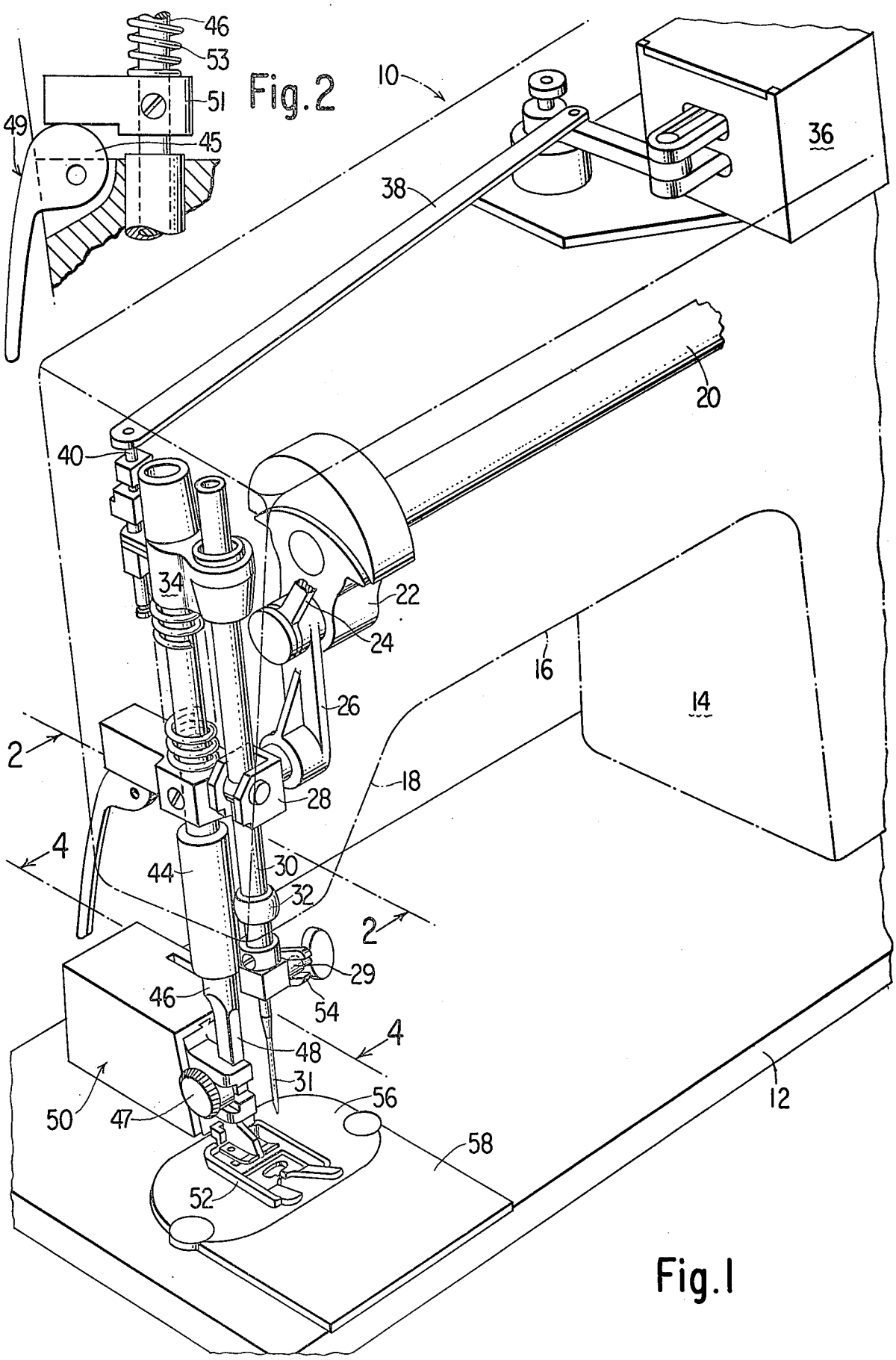
FIG. 1 is a perspective view of a sewing machine with a portion of the frame in phantom to show the internal details thereof.

Referring now to FIG. 1, there is shown a sewing machine 10 including a bed 12 supporting a standard 14 rising from one end of the bed, which standard supports a bracket arm 16 shown in phantom and terminating in a head 18. Visible within the bracket arm 16 and head 18 is a horizontal arm shaft 20 which is urged to rotate by a driving means (not shown). The horizontal arm shaft 20 terminates in a crank 22, which crank is connected to a sewing machine take up 24, only a portion of which is shown, and to one end of a connecting link 26, the other of which is connected to a driving stud 28 attached to a sewing machine needle bar 30 which is journalled for endwise reciprocation in ball sleeve 32 and needle bar gate 34 pivotably carried in the head end 18. The needle bar gate 34 is urged in selected lateral oscillation by a linear motor 36 carried in the bracket arm 16 and connected to the needle bar gate by means of a driving arm 38 and stud 40 affixed to the needle bar gate. Lateral oscillation of the needle bar gate 34 causes the needle bar 30 to swivel about the ball sleeve 32 captured in a socket (not shown) in the head 18, in order to influence lateral oscillation of sewing needle 31 affixed to the end of the needle bar 30.

Situated behind the needle bar 30 and supported by presser bar bushing 44 affixed in head 18, is a presser bar 46 which is urged downwardly against a stop towards the bed 12 by a resilient means (not shown). The presser bar 46 terminates in a slabbed off portion 48 to which may be affixed a presser foot, or as in this case, an attachment 50 having a presser foot 52 extending therefrom and a fork 54 which encircles a portion of the needle clamp 29 affixed to the needle bar 30 for retaining the sewing needle 31, in order that the attachment 50 may be activated by the endwise reciprocation of the needle bar 30. The attachment 50 is retained to the slabbed off portion 48 of the presser bar 46 by means of presser bar screw 47. The presser foot 52 of the attachment 50 is urged against a throat plate 56 in the bed 12 so as to cooperate with feed dogs (not shown) part of a feed system (not shown) which would be located in the bed 12 of the sewing machine as is well known in the sewing machine art. Bed slide 58 provides access to a loop taker (not shown) positioned in the sewing machine bed 12, and to a lower thread bobbin (not shown) also located therein, as is also well known in the sewing machine art.

Referring to FIG. 2, there is shown the presser bar 46, with a presser bar guide block 51 affixed thereto. A compression spring 53 extends against the presser bar guide block 51 to urge the presser bar 46 downwardly towards the bed 12. A presser bar lifter lever 49 is fashioned with a lifter cam 45, as is well known in the sewing machine art, so as to elevate the presser bar 46 out of contact with the sewing machine bed 12. As will be explained below, however, the attachment 50 is dimensioned to allow the presser bar 46 to shift downwardly so that the presser bar guide block 51 rests upon the lifter cam 45 of the presser bar lifter lever 49. In this fashion, presser pressure may be readily controlled internally of the attachment 50.

Figure 3:
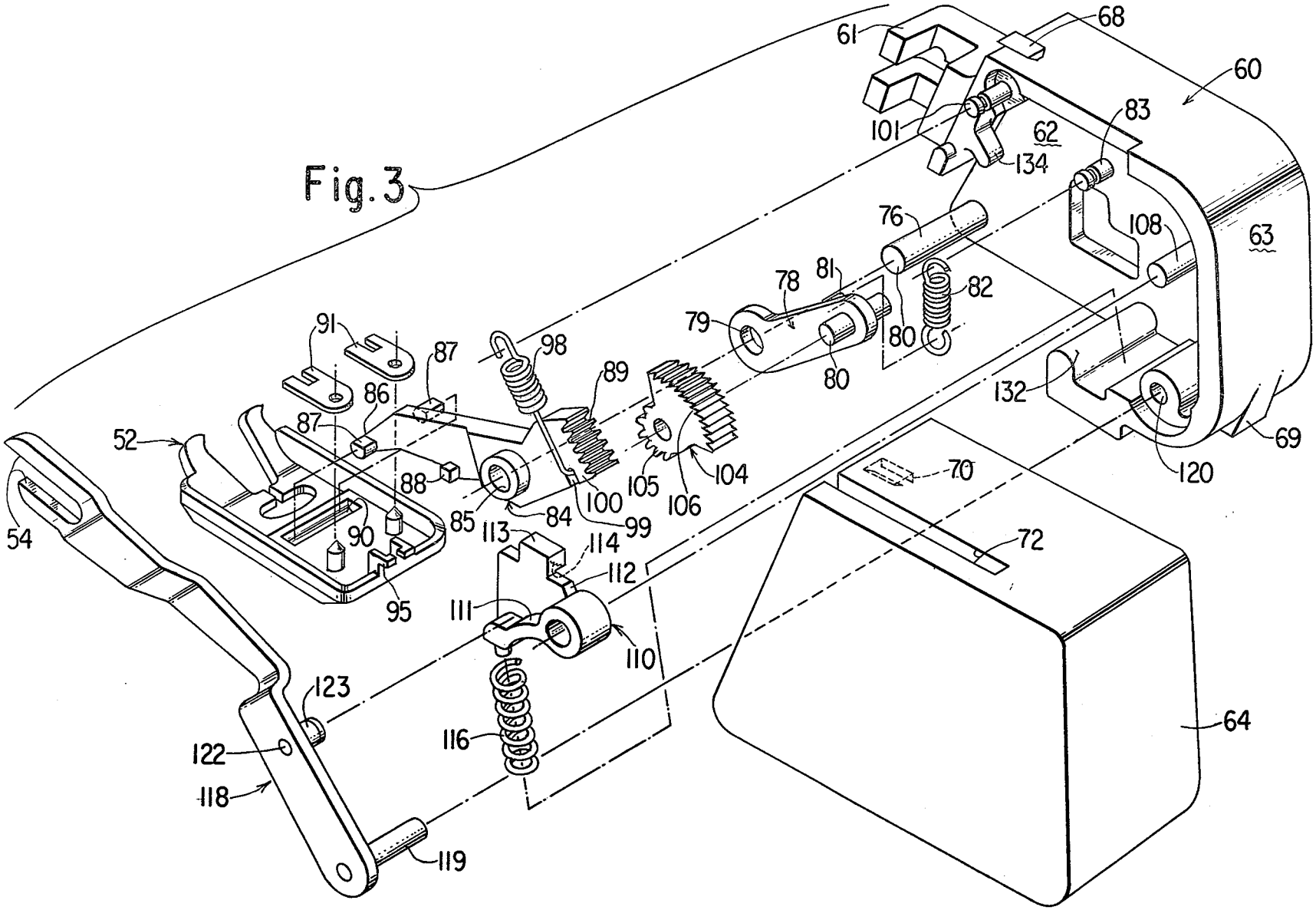
FIG. 3 is an exploded view of the attachment to the presser bar shown in FIG. 1.

Referring now to FIG. 3, there is shown an exploded perspective of the attachment 50 taken from the opposite side shown in FIG. 1. The attachment 50 includes a housing 60 having a lug 61 extending from a forward portion thereof for encircling the slabbed off portion 48 of the presser bar 46 so as to enable attachment thereto by means of the presser bar screw 47. The lug 61 is split so as to be able to extend on both sides of the presser bar screw 47. The housing 60 is formed with a side wall 62 and a wall 63 extending from a portion of the front, top, rear and a portion of the bottom periphery of the side wall to form an enclosure open opposite the side wall and diagonally downward toward the front. A cover 64 fits over the housing 60 to cover the top and rear portions of the wall 63 and the open side opposite the side wall 62, as well as the side wall 62. The cover 64 is retained to the housing 60 by means of a tapered lug 69 of the housing (see also FIGS. 4 and 5) extending through aperture 66 in the cover. The housing 60 may be fashioned with an upwardly expanding key 68; and the cover 64 may be fashioned with an upwardly opening keyway 70 complementary to the key 68, so that sliding engagement of the keyway with the key assists in retaining the cover to the housing. A slot 72 is provided in the upper surface of the cover 64 for a purpose which will become apparent below.

A rod 76 extends from the side wall 62 of the housing 60 to pivotably support thereon a pinion carrier lever 78 through a bore 79 in a first end thereof, and a presser foot carrier lever 84 through a bore 85 substantially centrally thereof. The presser foot and pinion carrier levers 84, 79 are retained on rod 76 by inside wall of cover 64. On a first end 86 of the presser foot carrier lever a pair of rods 87 extend out from either side of the similarly rounded end of the lever and are received in a cavity 90 in a preferably molded plastic presser foot 52 to pivotably retain the presser foot to the carrier lever 84. Retaining plates 91 are affixed to the presser foot by heat deformation of cylindrical bosses 92 molded as part of the presser foot, to retain the rods 87 in the cavity 90 without interferring with the pivotal motion thereof. A pair of laterally extending lugs 88, only one of which is visible, extends from a presser foot carrier lever 84 between the rods 87 and the bore 85, and are situated beneath rearwardly extending lugs 95 on the presser foot 52 to insure that the presser foot is evenly lifted as the presser foot carrier lever 84 is rotated so that no part of the presser foot will drag upon the work material.

The end 100 of the presser foot carrier lever 84 opposite the first end 86 thereof, is formed with a gear segment 89. An extension spring 98 is provided having a first hook end thereof carried in a slot 99 cut in the bottom of the second end 100 of the presser foot carrier lever 84, adjacent the gear segment 89 thereof. The second end of the extension spring 98 is captured in a groove on the end of a pin 101 molded as part of the housing 60 or inserted in an aperture therein. Thus, the presser foot 52 is urged against the work material by the extension spring 98.

The pinion carrier lever 78 having a bore 79 on the first end thereof carried on the rod 76 extending from the housing 60, is fashioned on the other end thereof with laterally extending pin 80 on either side thereof. Approximately intermediate the bore 79 and pin 80, there is located a tang 81 for receiving a first end of an extension spring 82 having its other end retained in a groove on a pin 83 molded as part of the housing 60 or inserted into an aperture therein. The pin 80 on the side of the pinion carrier lever 78 adjacent the presser foot carrier lever 84 supports thereon a combined pinion and ratchet 104, the pinion portion 105 of which is in an optimum mesh with the gear segment 89 on the second end 100 of the presser foot carrier lever 84. It will be apparent to those skilled in the art that any relative motion between the presser foot carrier lever 84 and the pinion carrier lever 78 occassioned by a change in thickness of the work material beneath the presser foot 52, will have no effect on the mesh of the gear segment 89 with the pinion portion 105 of the combined pinion and ratchet 104 because neither the pitch radius of the gear segment nor the pitch radius of the pinion portion has been shifted radially by this relative motion. This is so because the presser foot carrier lever 84 and the pinion carrier lever 78 are both pivoted on the rod 76. Thus, the presser foot 52 may respond to varying thickness of the work material therebeneath by shifting vertically and rotating the presser foot carrier lever 84 and, thereby, rotating the combined pinion and ratchet 104.

Also extending from the housing 60 is a pivot post 108 which pivotably supports thereupon a combined cam and pawl 110. The combined cam and pawl 110 is fashioned with a cam surface 111 on one side of a wall 112, and an overhanging lug 113 extending from the top of the wall and over the opposite side of the wall from the cam surface with a pawl 114 having mating teeth for the ratchet portion 106 of the combined pinion and ratchet 104. A compression spring 116 is provided to separate pawl 114 of the combined cam and pawl 110 from the ratchet portion 106 of the combined pinion and ratchet 104 unless the combined cam and pawl is pivoted on the pivot post 108 to bring about engagement of one with the other.

In order to effect engagement of the pawl 114 with the ratchet portion 106, a drive lever 118 is provided which is oscillated by the needle bar 30 by way of the fork 54 connection to the needle clamp 29 referred to above. The drive lever 118 is formed with a pivot pin 119 on one end thereof, which pivot pin is received in aperture 120 extending through bottom portion of wall 63. The drive lever 118 extends through slot 72 in the cover 64 so that the fork 54 on the end thereof may encircle the needle clamp 29. Spaced from the pivot pin 119, the drive lever supports a pin 122 on which is supported a roller 123, which roller is in engagement with the cam surface 111 of the combined cam and pawl 110. As the needle bar 30 undergoes endwise reciprocation, bringing about oscillation of the drive lever 118, the roller 123 progresses along the cam surface 111, rotating the combined pawl and cam 110 to bring the pawl 114 thereof into contact with the ratchet portion 106 of the combined pinion and ratchet 104. The joining of the pawl 114 with the ratchet portion 106 of the combined pinion and rachet 104 prevents further rotation of the combined pinion and ratchet so as to "freeze" the presser foot 52 at the level of the work material which is at that instant therebeneath. Thereafter, continued motion of the roller 123 down the cam surface 111 will cause the pawl 114 to shift the combined pinion and ratchet 104 by rotating the pinion carrier lever 78, thereby rotating the presser foot carrier lever 84 and elevating the presser foot 52 above the work material. Thus, the sewing needle 31 may be utilized to shift the work material laterally under the urgings of the needle bar gate 34.

Figure 4:
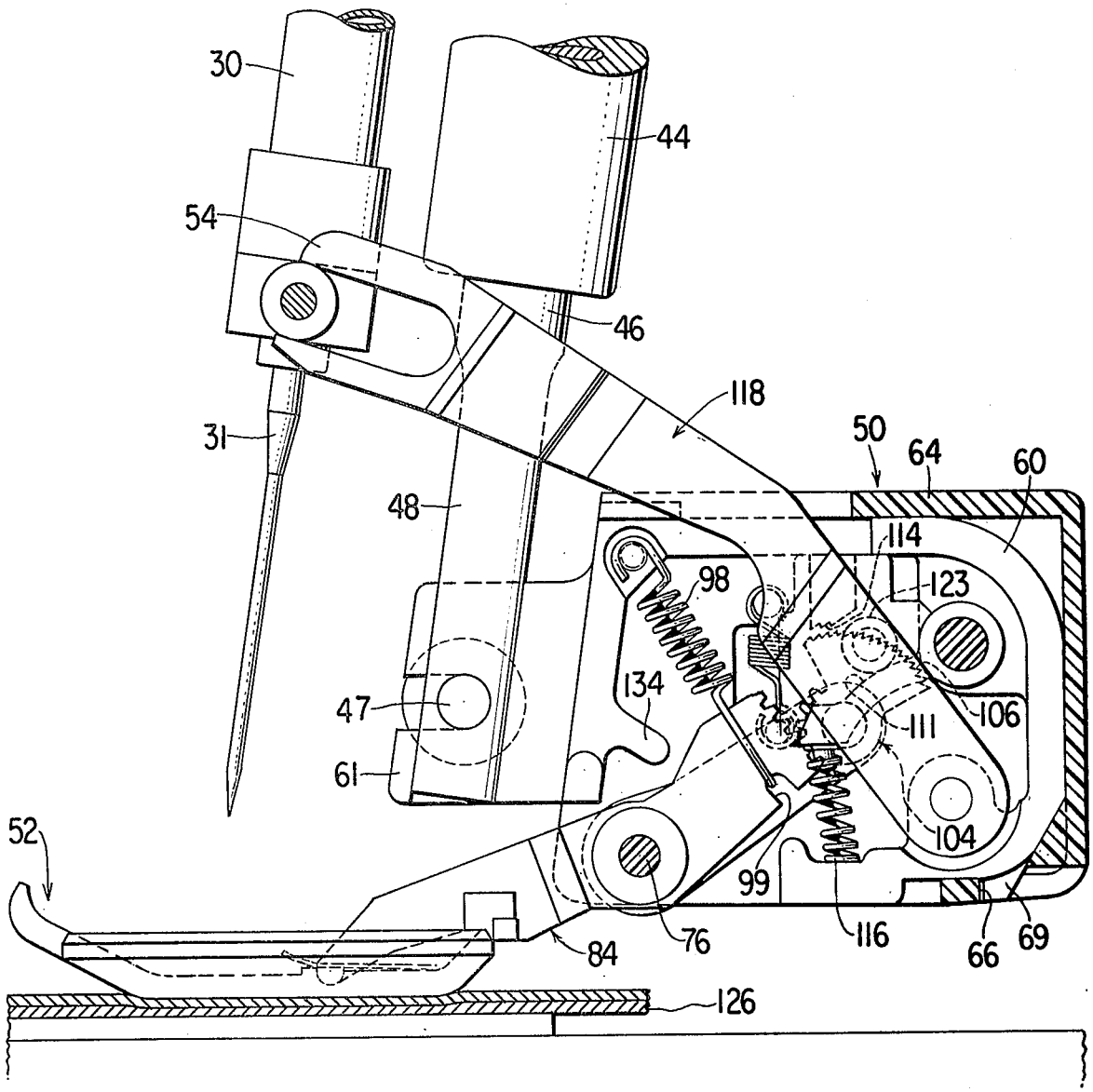
FIG. 4 is a cross sectional view of the attachment taken substantially along the line 4—4 of FIG. 1 with the sewing needle in an elevated position; and, FIG. 5 is a cross sectional view similar to FIG. 4 with, however the sewing needle in a depressed position.

Referring to FIG. 4, there is shown a cross sectional view of the attachment 50 with the needle bar 30 elevated and the sewing needle 31 out of contact with the work material 126 supported on the bed 12 of the sewing machine 10. The presser foot 52 is in contact with the work material 126 which is shown depressed to indicate that the presser foot is operating on the work material, for example, to eliminate flagging or combined motion of material and thread, which might occur as the sewing needle 31 is being withdrawn from the work material, and prevent stitch formation by interferring with loop pickup. In actuality, the presser bar 46 is not effective to urge the presser foot 52 against the work material, since, as is shown in FIG. 2, the presser bar guide block 51 attached to the presser bar rests upon the lift cam 45 of the presser bar lift lever 49. In this event, the presser foot 52 is urged against the work material 126 by the extension spring 98. In order that the presser bar guide block 51 will rest upon the lift cam 45, the attachment 50 is constructed with the distance between the center of the presser bar screw 47, captured in the split in the lug 61, and the bottom 55 of the presser foot 52, sufficiently less than that distance with any other presser foot to insure that the guide block will impinge on the lift cam. With any other presser foot attached directly to the presser bar 46, a gap would exist between the presser bar lift lever 49 and the presser bar guide block 51, which gap is closed as the lift lever is rotated to bring the lift cam 45 into engagement with the guide block, as is well known in the sewing machine art. In FIG. 4, the roller 123 is high on the cam 111, and the pawl 114 has not been forced to engage with the ratchet portion 106 of the combined pinion and ratchet 104. Thus, if the work material 126 were suddenly to include extra plies, for example, to add a patch to a garment, the presser foot 52 may shift vertically to accommodate the extra work material, rotating the combined pinion and ratchet 104 in the process.

Figure 5:
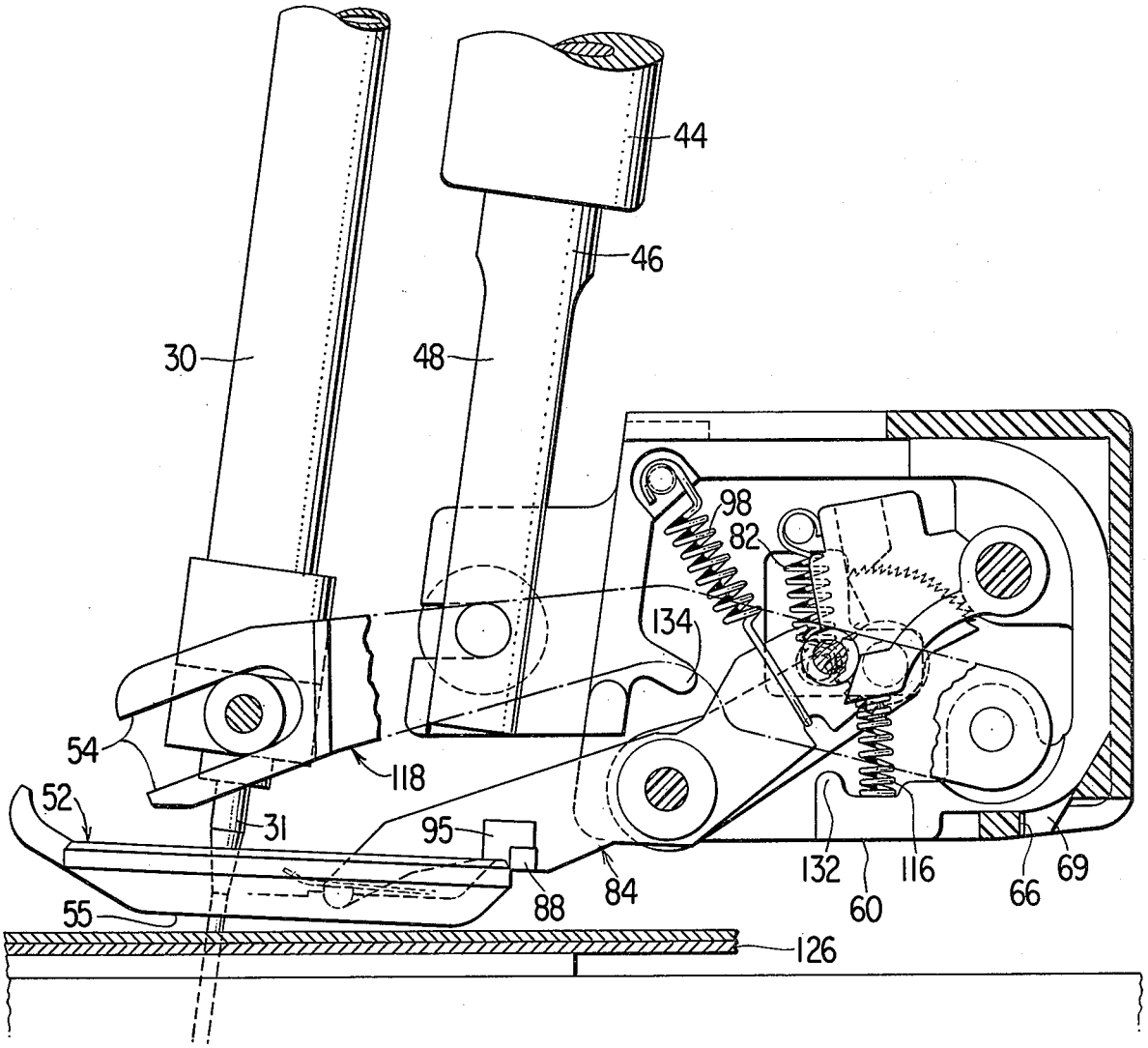

In FIG. 5, the sewing needle 31 extends through the work material 126 and the roller 123 has progressed down the cam 111 to the point where the pawl 114 is initially rotated into contact with the ratchet portion 106 of the combined pinion and ratchet 104 to inhibit further free rotation thereof, and thereafter the continued motion of the pawl 114 pivots the combined pinion and rachet carried on the pinion carrier lever 78 about the rod 76 so that the presser foot carrier lever 84 might also be pivoted about that rod to elevate the presser foot 52 out of contact with the work material 126. In FIG. 5, the laterally extending lugs 88 are shown positioned beneath the rearwardly extending lugs 95 of the presser foot 52 so as to limit the pivoting of the presser foot about the rods 87 of the presser foot carrier lever 84, thereby to insure that the presser foot does not remain in pressure contact with the work material 126. Extreme clockwise rotation of the presser foot carrier lever 84 as viewed in FIG. 5, is prevented by abutment 132 on housing 60, just as counterclockwise travel of the presser foot carrier lever by elevation of the presser bar 46 is prevented by lug 134 of the housing. By an inspection of FIGS. 4 and 5, it is apparent that the clockwise rotation of the presser foot carrier lever is implemented when the sewing needle 31 is well into the work material 126 since that portion of the cam surface 111 which implements this rotation is at the last third of its travel. The presser foot 52 is elevated out of contact with the work material 126, there being sufficient upward motion of the presser foot to remove all downward force. It is also apparent from FIG. 5, that location of the pawl 114 beyond the pivot axis of the combined pinion and ratchet 104, will impart an additional rotation to the combined pinion and ratchet which will further elevate the presser foot 52.

As the sewing needle 31 is elevated, and the roller 123 of the drive lever 118 rides up to the upper end of the cam surface 111 of the combined cam and pawl 110, the extension springs 82, 98 rotates the presser foot carrier lever 84 counterclockwise and reengages the presser foot 52 with the work material 126. When the pawl 114 disengages from the ratchet portion 106 of the combined pinion and ratchet 104, the extension spring 82 will allow a rotation of the pinion carrier lever 78 about the rod 76, causing a rotation of the combined pinion and ratchet 104 to adjust to the height of the work material 126 beneath the presser foot 52. The compression spring 116 will return the combined cam and pawl 110 to a clockwise most position, as shown in FIG. 4, in preparation for the next cycle.

Although the invention has been described in terms of a preferred embodiment or modification, such technical equivalents of the means described as well as their combination, and such other embodiments or modifications that may be suggested by those having the benefit of the teachings herein, are intended to be reserved should they be carried out according to the spirit of the invention.

We claim:

1. A presser device adapted for use with a sewing machine having a frame, a presser bar slidably supported by said frame, an endwise reciprocable needle bar carrying a sewing needle in the end thereof supported by said frame, and means in said frame for selectively laterally shifting said needle bar in the formation of zig zag stitching patterns, said device being adapted to be supported by said presser bar and being usable to implement lateral feeding of work material by said sewing needle when extended through said work material, said device comprising a presser foot, means for supporting said presser foot in a first position to implement needle penetration and withdrawal from a work material and in a second position to implement lateral feeding by said sewing needle; said supporting means including means for accommodating to various thicknesses of work material beneath said presser foot so as to enable lateral shift of various thicknesses of said work material by bringing said presser foot to said second position a fixed distance from said first position; said supporting means further including a presser foot carrier lever supporting said presser foot on one end thereof and means for pivotably supporting said presser foot carrier lever when bringing said presser foot to said second position when said sewing needle is in engagement with said work material; said accommodating means further comprising a gear segment on the end of said presser foot carrier lever opposite said presser foot, a pinion and a pinion carrier lever supported on said pivotably supporting means and carrying said pinion on a first axis in mesh with said gear segment.

2. A presser device as claimed in claim 1 further comprising a housing having a lug thereon for attachment to said presser bar, a portion of said supporting means being carried in said housing, a drive lever having a first end pivotably carried by said housing and the second end operably connected with said needle bar to impart oscillations to said drive lever, a pin extending laterally from said drive lever spaced from said first end, a roller rotatably carried by said pin; said pinion further comprising a ratchet combined therewith; a combined pawl and cam pivotably carried by said housing on a second axis with a cam portion thereof in engagement with said roller and a pawl portion thereof out of engagement with said ratchet when said needle bar is in one extreme position with said sewing needle not extended through said work material and in engagement with said ratchet when said sewing needle extends through said work material, whereby said combined pawl and cam when said sewing needle extends through said work material prevents rotation of said pinion about said first axis and influences motion of said pinion and said presser foot carrier lever to elevate said presser foot in a direction out of contact with said work material.

3. A presser device as claimed in claim 2 wherein said pawl of said combined pawl and cam pivotably carried on said second axis extends from said second axis beyond said first axis of said pinion and cooperates with said ratchet combined with said pinion to influence an additional rotation of said pinion further elevating said presser foot.

4. A presser device as claimed in claims 2 or 3 wherein said sewing machine further includes a presser bar guide bracket attached to said presser bar, a compression spring biased between said frame and said presser bar guide bracket to urge said presser bar towards said work material, a presser bar lifting lever having a lift cam for selective engagement in a rotated position of said lifting lever with said guide bracket for elevation of said presser bar, said presser device further comprising a distance between said lug for attachment to said presser bar and the bottom surface of said presser foot in contact with said work material which will cause said guide bracket to impinge on said lift cam with said lifting lever in a non rotated position.

* * * * *